US005392877A

United States Patent [19]

Shahin et al.

[11] Patent Number: 5,392,877

[45] Date of Patent: Feb. 28, 1995

[54] EMERGENCY ESCAPE SYSTEM FOR MULTISTORY BUILDINGS

[76] Inventors: Abdul A. Shahin; Mustafa A. Shahin, both of 302 E. Brinkerhoff Ave., Palisades Park, N.J. 07650

[21] Appl. No.: 206,659

[22] Filed: Mar. 7, 1994

[51] Int. Cl.[6] ..... B66B 9/00

[52] U.S. Cl. ..... 182/82

[58] Field of Search ..... 182/82, 37, 141; 187/6

[56] References Cited

U.S. PATENT DOCUMENTS

| | | | |
|---|---|---|---|
| 461,499 | 10/1891 | Grnst | 187/6 |
| 2,936,083 | 5/1960 | Dahlman | 187/6 X |
| 3,880,258 | 4/1975 | Rompa | 187/6 X |
| 3,945,469 | 3/1976 | Dorcich | 182/142 |

*Primary Examiner*—Alvin C. Chin-Shue
*Attorney, Agent, or Firm*—M. K. Silverman

[57] ABSTRACT

An emergency escape system for use within a multistory building includes a vertical horizontal balconies each having an open area defining resulting open areas which, in turn, define a vertical column through the balconies. The system further includes a rigid vertical channel structure within each of the vertical columns, each of the channel structures having vertical guides. The system also includes an escape module having a rigid platform proportioned to substantially fill each of the open areas of each balcony, the module including an assembly for slidable engagement with the vertical guides of each vertical channel. The system also includes springs secured within the vertical guides which are in compressible abutment with the slidable engagement assemblies of the escape module. The system also includes an assembly for selectable release of the slidable engagement assembly of the escape module from each of the balconies and into compressive contact with the springs. The system also includes an assembly for limiting the extent and velocity of downward travel of the module between successive balconies.

2 Claims, 7 Drawing Sheets

EMERGENCY ESCAPE SYSTEM FOR MULTISTORY BUILDINGS

BACKGROUND OF THE INVENTION

1. Technical Field

The present invention relates to an emergency fire escape system particularly for use in multi-story high rise buildings and, particularly, to such escape systems concerning external means of escape from such buildings, 2. Background of Art External emergency escape systems, as are known in the prior art, typically involve the use of an elevator or rail car. In such approaches, it is necessary to wait until the elevator arrives at the exact level where the person or party requiring rescue located.

U.S. Pat. No. 4,865,155 to Montaigne discloses an external system which employs railroad car-like vehicles upon a track. Such a system, while having some value to professional fire fighters, does not provide a personalized type of rescue system that would be virtually instantaneously available to a potential user. Further, a system of the type of Montaigne will effect upon the exterior appearance of a building and therefore, if for no other reason, would not be acceptable to most building owners.

U.S. Pat. No. 4,671,384 teaches a window escape descent control device. It however is of value only to very fit or athletic, not the very old, the young or the disabled.

The present invention provides a system of emergency escape integrated into balconies of or within a high rise structure which, thereby, is accessible on an individual basis to the occupants of every apartment equipped with such a special balcony.

SUMMARY OF THE INVENTION

The invention relates to an emergency escape system for use within a multi-story building. The system, more particularly, comprises a vertical plurality of horizontal balconies each having an open area therein defining a resulting plurality of open areas, in turn defining a vertical column through said plurality of balconies. The system further includes a rigid vertical channel structure within each of said vertical columns, each of said channel structures having vertical guide means therein. The system yet further includes an escape module having a rigid platform proportioned to substantially fill each of said open areas of each balcony, said module including means for slidable engagement with said vertical guide means of each of said vertical channels. The inventive system also includes spring means secured within said vertical guide means which are in compressible abutment with said slidable engagement means of the escape module. The system further includes means for selectable release of said slidable engagement means of the escape module from each of said balconies and into compressive contact with said spring means. The system also includes means for limiting the extent and velocity of downward travel of said module between successive balconies.

It is accordingly an object of the present invention to provide a personalized escape vehicle for residents of a multi-story building.

It is another object of the invention to provide an escape vehicle for residents of a multi-story building incorporated into balconies thereof.

It is a further object to provide a system providing for escape from one apartment to a successive apartment balcony therebeneath.

It is a yet further object of the present invention to provide a means of the above type which is adaptable for effecting the escape of handicapped persons.

It is a still further object to provide a means of the above type which will not degrade the cosmetic or external appearance of a multi-story structure provided with the inventive system.

The above and yet other objects and advantages of the present invention will become apparent from the hereinafter set forth Brief Description of the Drawings, Detailed Description of the Invention and Claims appended herewith.

DETAILED DESCRIPTION OF THE INVENTION

Figure 1:
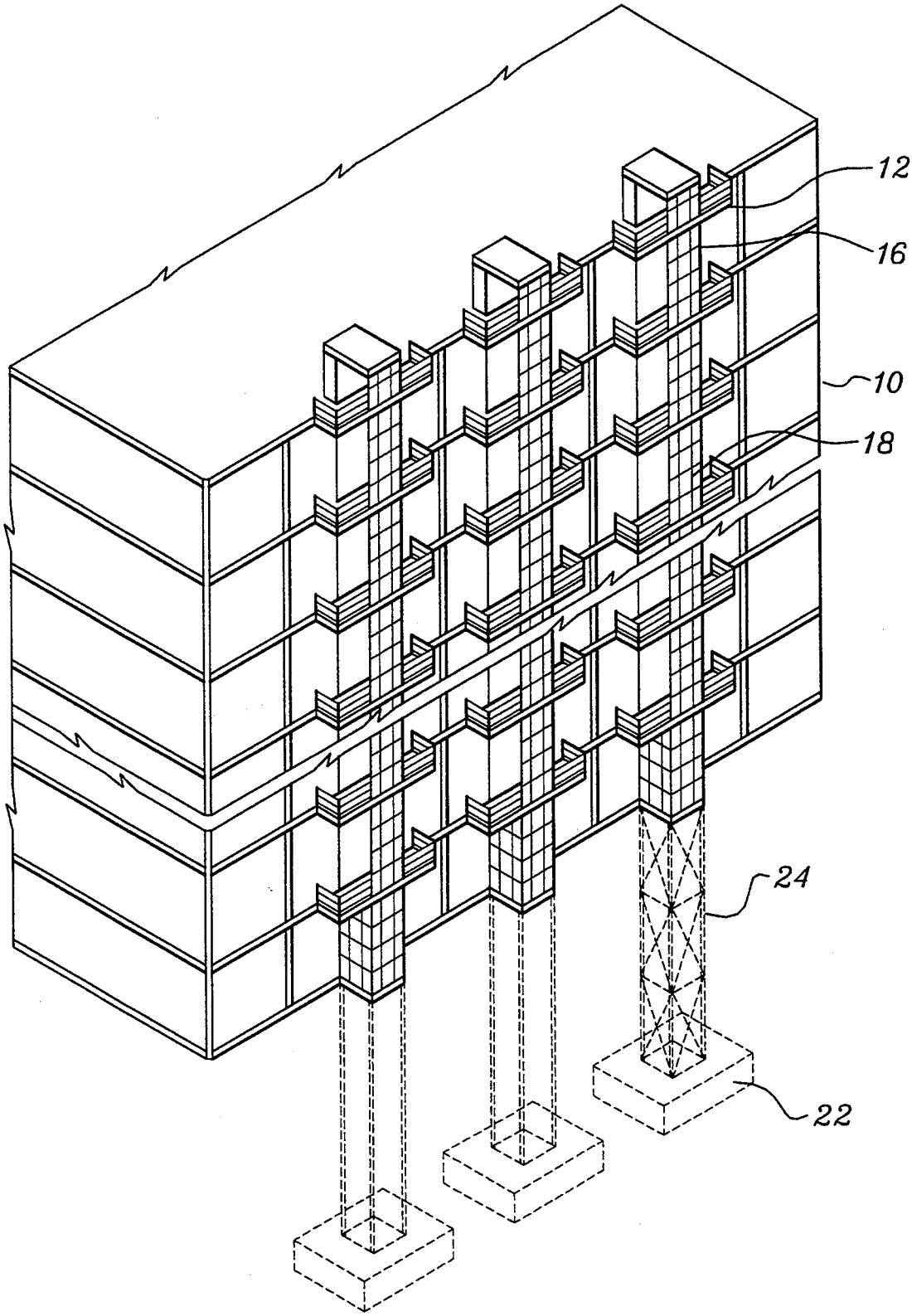
FIG. 1 is a perspective view of a multi-story building furnished with the inventive system.
Figure 2:
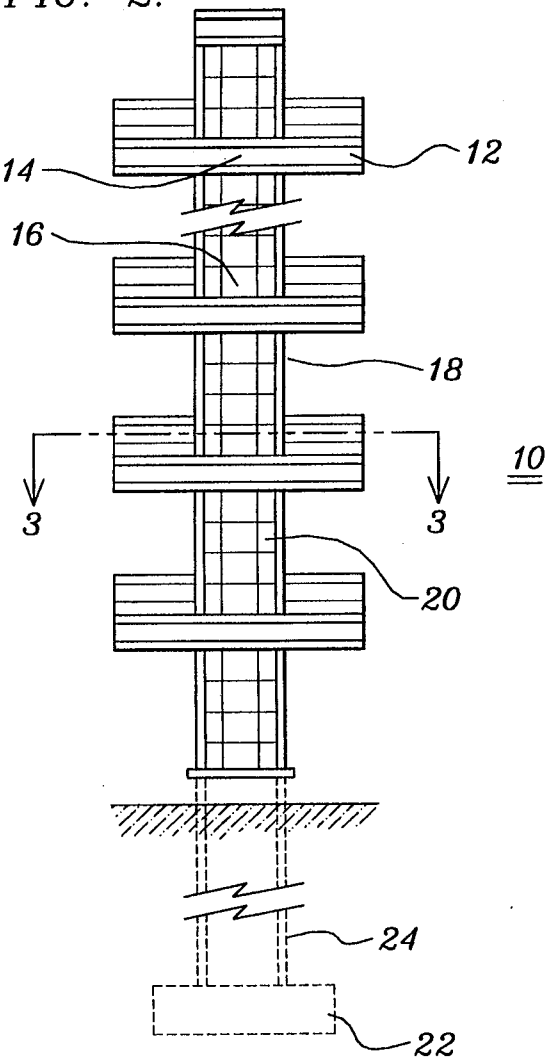
FIG. 2 is a front enlarged view of the vertical channel and balcony structure of the instant invention.
Figure 4:
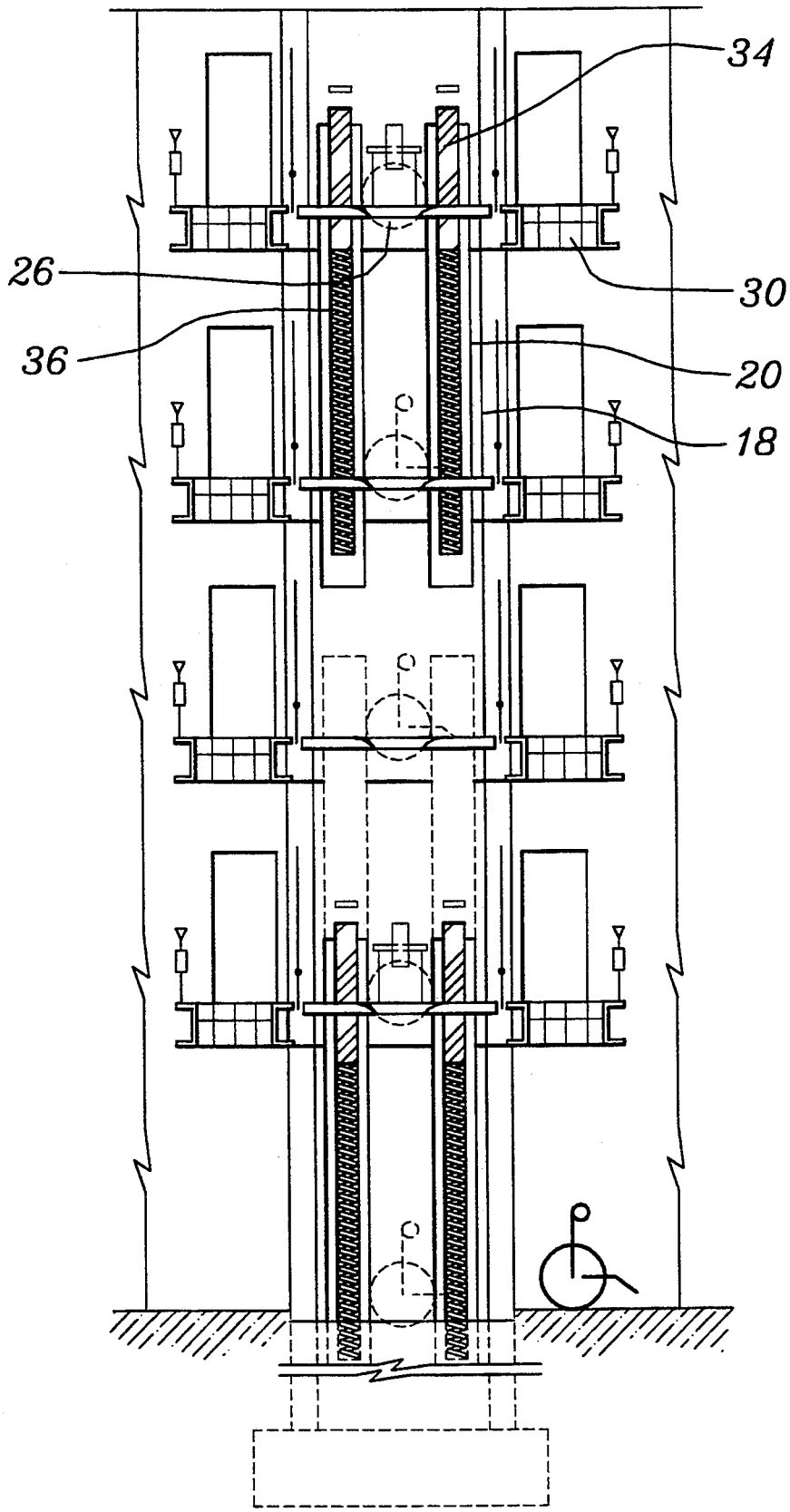
FIG. 4 is a cross-sectional view showing the inventive system taken along Line 4—4 of FIG. 3.
Figure 5:
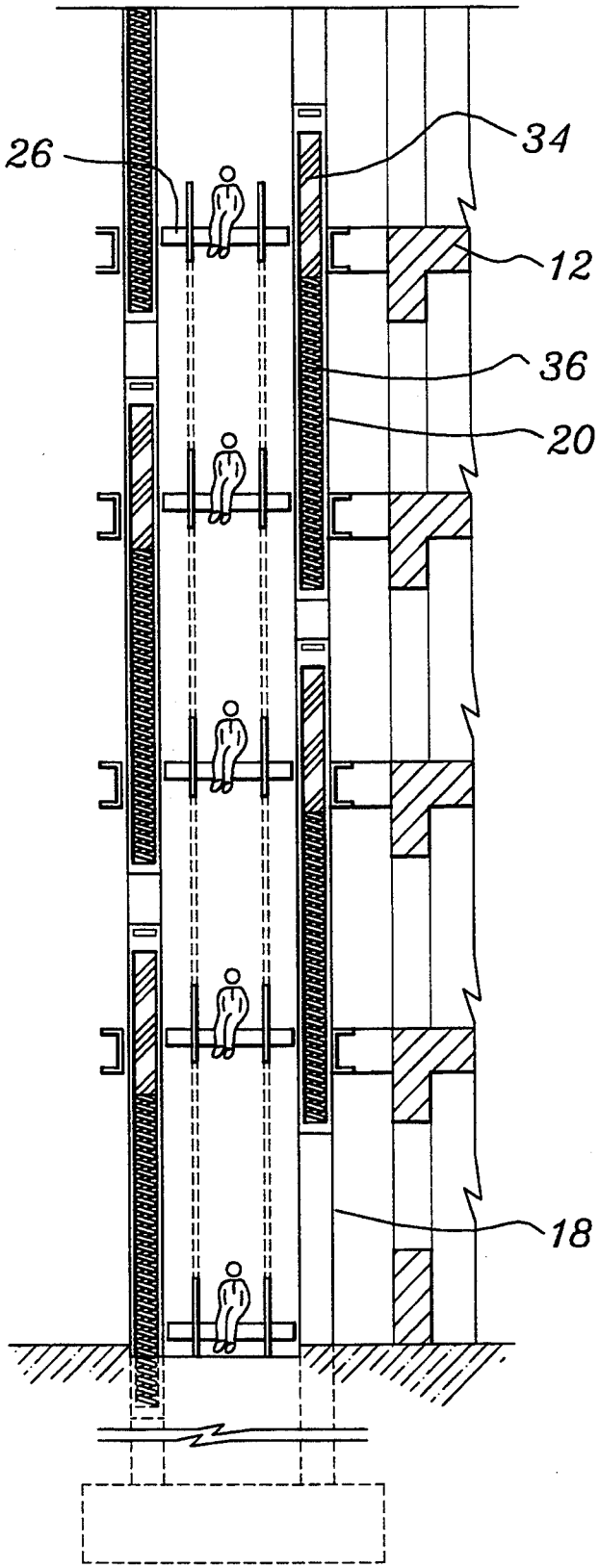
FIG. 5 is a side cross-sectional view of the system taken along Line 5—5 of FIG. 3.
Figure 6:
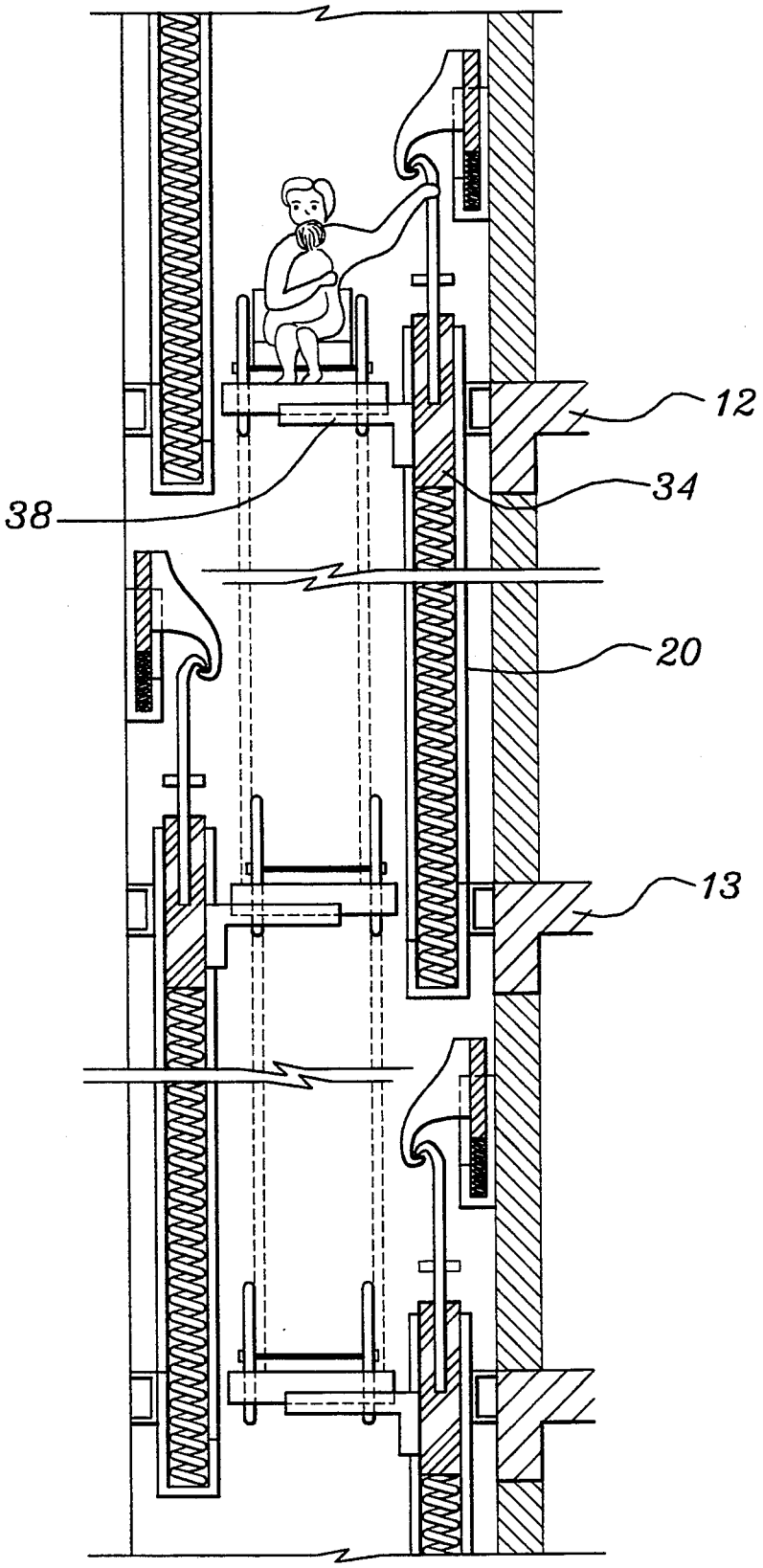
FIG. 6 is a detailed view of the spring means and platform release means in accordance with the instant invention.

With reference to the perspective and front views of FIGS. 1 and 2, there is shown a multi-story building 10 of the type to which the instant invention is applicable. Shown on the outer surface thereof is a vertical plurality of balconies 12, each of which are provided with an open area 14 in the floor thereof. Said open areas 14 define a vertical plurality of such open areas which in turn define the geometry of a vertical column 16 which passes through the plurality of balconies 12. Formed within each of said vertical columns 16 is a rigid vertical channel structure 18 which is more particularly described with reference to FIGS. 4 thru 6 below. Included within each vertical column 16 is vertical guide means 20. See FIG. 3.

With further reference to said vertical channel structure 18 it is noted that a foundation 22 is provided so that extensions 24 of the vertical channel structures may be countersunk deep within the ground to provide suitable rigidity and stability to the instant system.

Figure 3:
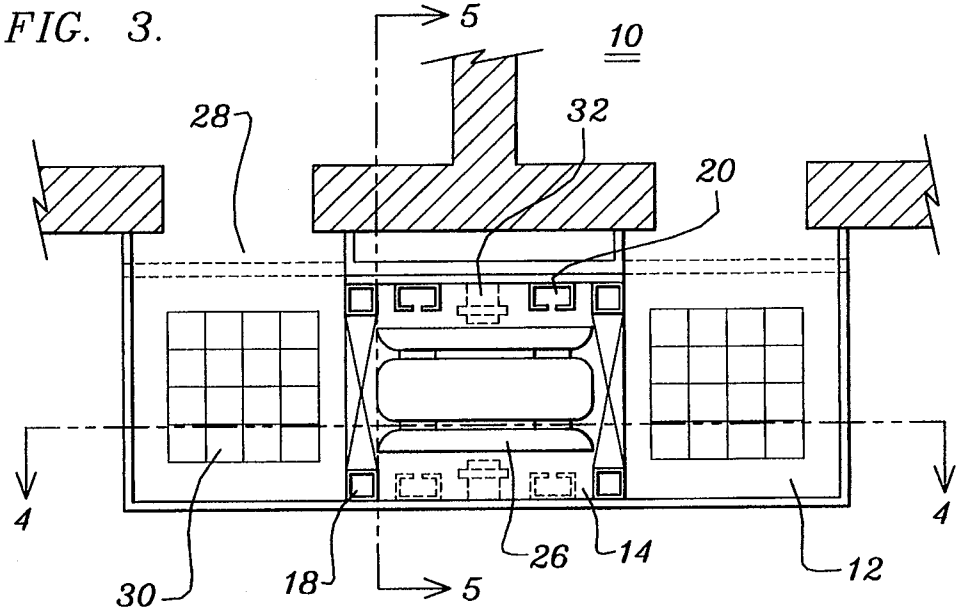
FIG. 3 is a top plan view of a balcony taken along Line 3—3 of FIG. 2.

There is, in FIG. 3, shown a plan view of each balcony 12 which includes a horizontal cross-sectional view of the various vertical elements of the present invention. More particularly, there may, in the view of FIG. 3 be seen said vertical channel structure 18 and said vertical guide means 20. This said vertical guide means 20 is transferred to the opposite side alternatively at each balcony level. Positioned within opening 14 of balcony 12 is shown an escape module 26 as it is normally positioned in the absence of an emergency by means of handrail 32 pivotally connected with the module 26 by a hinge 69 (see FIG. 6A), and interlocked with the detent means 48. Both the handrail 32 and the detent 48 being transferred to the opposite side alternatively at each balcony level. It may, from the view of FIG. 3, be appreciated that escape module 26 is stationed at the balcony level and near to a window or other exit 28 of building 10. Accordingly, a user may readily walk-over solid glass or transparent bricks 30 of which most of the floor of the balcony 12 is formed. The provision of such a transparent flooring is necessary so that a user of the system may observe both below and above his balcony level to ascertain whether a party escaping either at the level above or below his balcony is about to descend to the next lowest level. The user may further assure his safety by use of the module braking mechanism (see FIG. 8) before entering or leaving the vertical column 16 as mentioned. Thereby, a means exists for the coordination, as may be necessary, of escape on a balcony-by-balcony basis in accordance with the present system as is more fully set forth below.

Figure 6A:
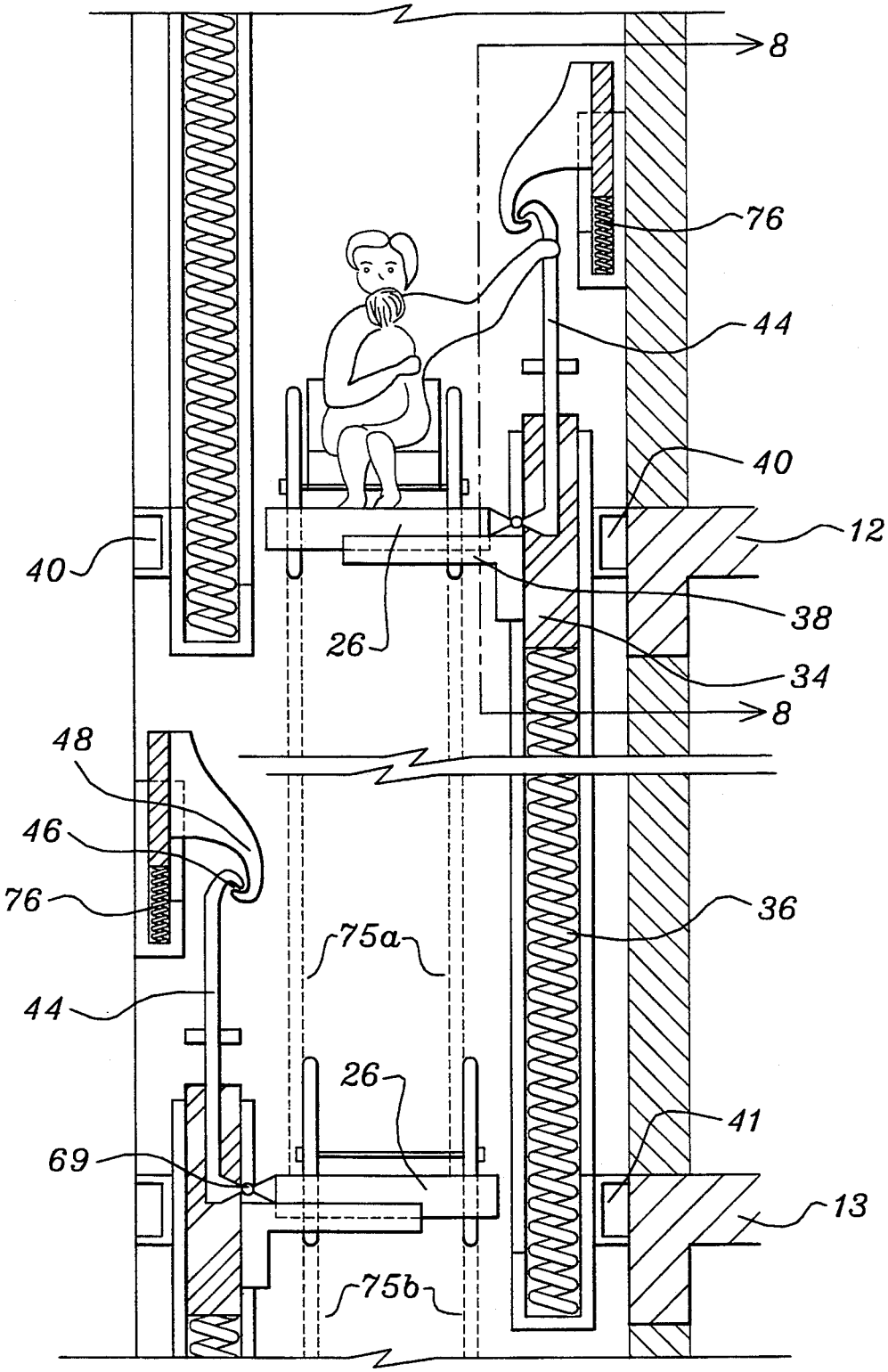
FIG. 6A is an enlarged detailed view of the upper portion of FIG. 6.

With further reference to the view of FIG. 3, the escape module 26 may be seen to include a handrail 32 which is pivotally connected to a base of the escape module 26 by hinge 69 (see FIG. 6A). Said handrail 32 includes a vertical bar 44 having its upper portion 46 interlocked with detent means 48 which is in abutting relationship to strong spring means 76. Only when the vertical bar 44 is slightly pushed forward can it be released from detent means 48 so that, instantaneously, the entire module 26 will descend under the weight of the escaping user. Said module 26, with its handrail 32, when totally discharged returns up to its detent position under the action of the expanding spring 36. The entire module 26 interlocks to the detent wherein exists controlling means for initiating a new departure.

With reference to the front and side vertical cross-sectional views of FIGS. 4 to 6A, each vertical channel structure 20 may be seen to include a moveable hardwood column 34 which is in abutting relationship to a spring means 36, both of which are within channel structure 20. Through the use of two angle irons 38 (see FIG. 6) each escape module 26 is rigidly secured to two hardwood columns 34. Accordingly, in the manner shown in FIGS. 6 and 6A, the module 26 may be selectably released from a horizonal channel 40 upon the selectably release of vertical bar 44 which comprises a means for release of the module 26 from its position co-planar with horizontal channel 40 and balcony 12. Thereupon the entire module 26 connected with the vertical bar 44, and its upper portion 46, with handrail 32, will descend downwardly as the said spring 36 is compressed to the level of the balcony 13 immediately beneath balcony 12, the level of balcony 13 being a level at which the weight of the loaded module 26 is approximately balanced by the spring action of the compressed spring 36.

If the module 26 of the balcony 12 descends under a very heavy weight after being released from the detent 48 associated with the balcony 12, when it reaches the balcony 13 immediately beneath, it will strike the module 26 that belongs to the balcony 13. The entire module 26 will go down for a short distance to the level of balcony 13 without releasing the detent 48 that belongs with balcony 13, and which also is in abutting relationship to spring 76 (shown in FIG. 6A) comprising means for minimizing the reaction against the striking force.

According to the present invention, the intent is to effectuate escape from a particular floor or apartment, that is the subject of fire or smoke hazard, on a level-by-level basis, as opposed to a generalized escape method from a given level all the way down to street or ground level.

Figure 7:
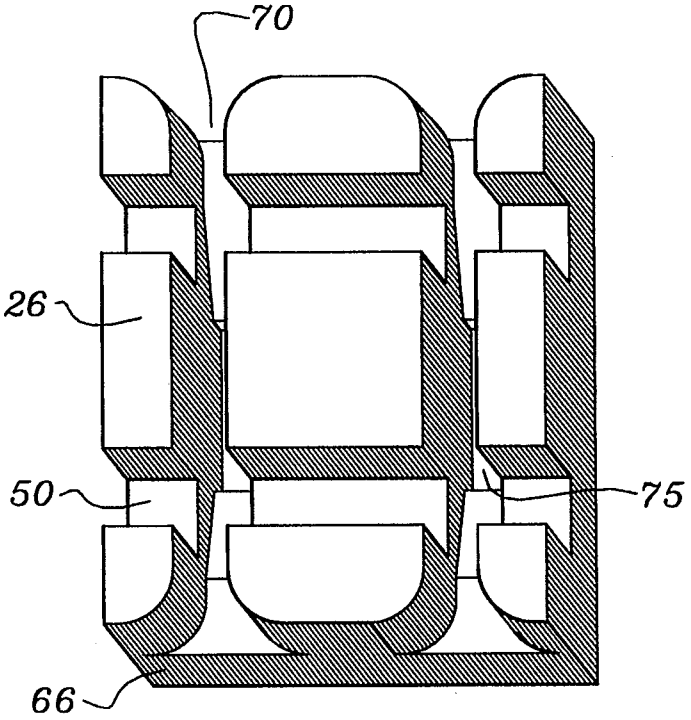
FIG. 7 is an enlarged perspective view of the escape module of FIG. 3.

There is, more particularly, shown in FIG. 7 the base of escape module 26 which includes two grooves 70 having a guide to facilitate the entering of the wheelchair by an escaping handicapped person along two openings 75. Therein two wheel recesses define means of stabilization—the said two openings 75 alternatively at every next escape module are slightly shifted to **75*b* as shown in FIG. 6A having easier department from the loaded escaping module 26 when it is in the same level as that immediately beneath said escaping module 26 belonging to said level. Holding the arm 68 shown in FIG. 8, the said department would be more easier. There is also more particularly shown in FIG. 7 two grooves 50 on the upper side of said escape module 26 having the thickness of said steel angles 38**.

Figure 8:
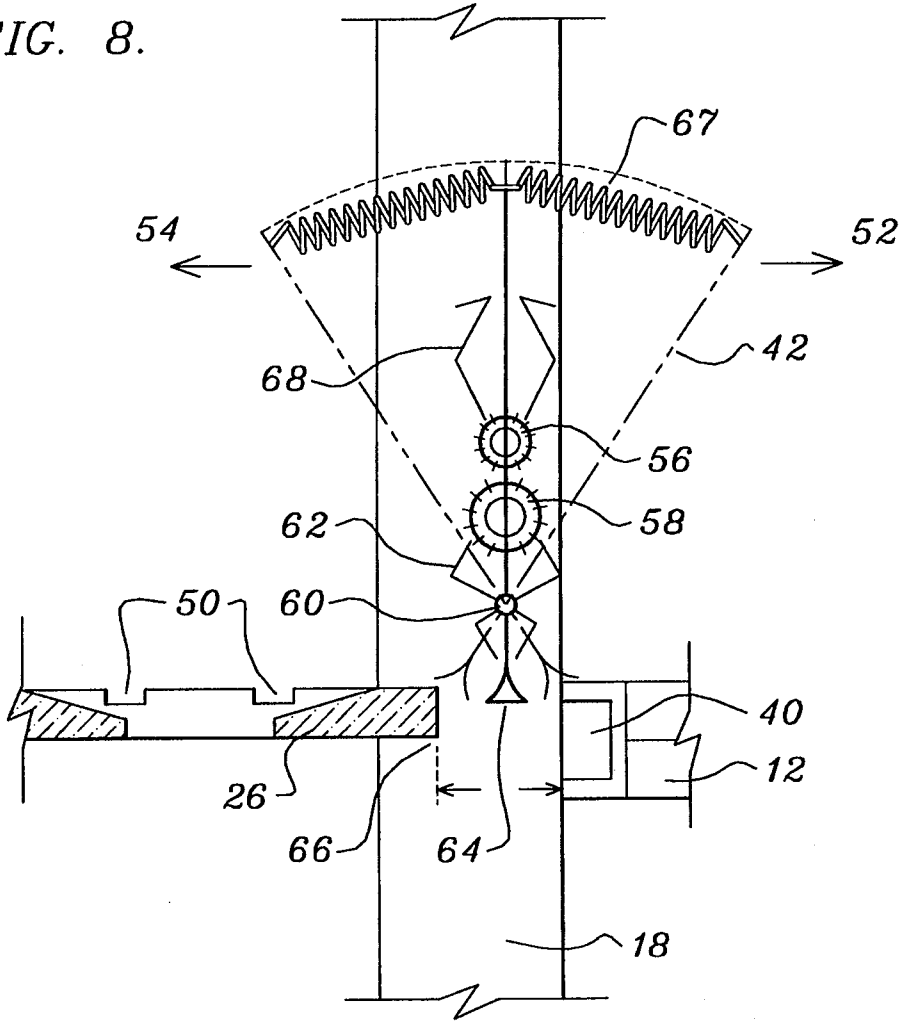
FIG. 8 is a schematic view showing the module braking mechanism taken along Line 8—8 of FIG. 6A.

In FIG. 8 is shown a forward portion of module 26 belonging to the balcony 12 in position when there is no emergency and a vertical bar 64 with its entire connections, that is, two pairs of rotating arms 62 and 68, and a spring 67 fixed with the upper portion and also two pinion gears and 56 and 58 fixed to the vertical column 18. The vertical bar 64 is also pivotally connected to the vertical column 18 by hinge 60.

In the event of an emergency, the escaping individual, before standing on the module 26, takes the vertical bar 64 to the position 54 by holding and rotating the arm 68. The vertical bar 64 has a certain weight that prevents the descending of the upper module 26 (belonging to the balcony 11) at the instant of release of detent 48 of balcony 11. While holding the arm 68, the said escaping individual slightly pushes forward the vertical bar 44 by using the other hand or his leg. Thereupon the loaded module 26 will descend to the next balcony 12 wherein the escaping individual before leaving his module 26, will hold the arm 68 and rotate it to urge the vertical bar 64 to take the position 52. Therein the said module 26 will descent from balcony 11 and will be locked at the level of balcony 12 until the passengers have been discharged. Thereupon the passenger releases the arm 68 and the bar 64 is rotated to permit the module 26 to be elevated to the level of the balcony 11 by the expansion of the spring 36. Accordingly the upper portion 46 of bar 44 (see FIG. 6A) will again be interlocked by detent means 48 in the presence of the hinge 69.

Also shown in the view of FIG. 8 is a stabilizing spring 67 the function of which is to return vertical bar 64 to the vertical position if it moves toward either position 52 or 54.

Accordingly, while there has been shown and described the preferred embodiment of the present invention, it is to be understood that the invention may be embodied otherwise than is herein specifically shown and described and that within said embodiments certain changes may be made in the form and arrangements of the parts without departing from the underlying ideas or principles of this invention as set forth in the Claims appended herewith.

Having thus described our invention what we claim as new, useful and non-obvious and, accordingly, secure by Letters Patent of the United States is:

1. An emergency escape system for a multi-story building, the system comprising:

(a) a vertical plurality of balconies, each having an open area defining a resulting plurality of said open areas which in turn define a vertical column through said plurality of balconies;

(b) a rigid vertical channel structure within each of said vertical columns, each of said channel structures having vertical guide means;

(c) an escape module having a rigid platform proportioned to substantially fill each of said open areas of each of said balconies, said module including means for slidable engagement with said vertical guide means of each of said vertical channel;

(d) spring means secured within said vertical guide means in compressible non-vibratory abutting relationship with said slidable engagement means of said escape module;

(e) means for selectable release of said slidable engagement means of said module from each of said balconies into compressive contact with said spring means; and (f) means for limiting the extent and velocity of downward travel between successive balconies of said module.

2. The system as recited in claim 1 in which each of said balconies comprise transparent brick elements.

* * * * *